US005818014A

United States Patent [19]

Smith et al.

[11] Patent Number: 5,818,014

[45] Date of Patent: Oct. 6, 1998

[54] AIR DISPENSERS FOR MICROWAVE OVEN

[75] Inventors: Donald P. Smith, deceased, late of Dallas, by Esther R. Smith, executrix; Michael J. Dobie, Double Oak; Alden B. Sparman, Sr.; John R. Norris, both of Plano; Neal S. Cooper, Fort Worth; Carl J. Dougherty, Grand Prairie, all of Tex.

[73] Assignee: Patentsmith Technology, Ltd., Dallas, Tex.

[21] Appl. No.: 461,258

[22] Filed: Jun. 5, 1995

Related U.S. Application Data

[63] Continuation-in-part of Ser. No. 357,705, Dec. 16, 1994, Pat. No. 5,510,601, and a division of Ser. No. 958,968, Oct. 9, 1992, Pat. No. 5,401,940, which is a continuation-in-part of Ser. No. 723,250, Jun. 28, 1991, Pat. No. 5,210,387, and Ser. No. 463,279, Jan. 10, 1990, Pat. No. 5,147,994.

[51] Int. Cl.[6] ..... H05B 6/64

[52] U.S. Cl. ..... 219/679; 219/681; 99/475; 221/150 HC; 221/150 A; 221/150 R

[58] Field of Search ..... 219/400, 679, 219/680, 681; 99/355, 357, 427, 473, 475; 126/21 A; 221/150 A, 150 R, 150 HC

[56] References Cited

U.S. PATENT DOCUMENTS

| | | | |
|---|---|---|---|
| 3,333,666 | 8/1967 | Murray et al. | 99/355 |
| 3,343,479 | 9/1967 | Wassberg | 219/400 |
| 3,386,550 | 6/1968 | Murray et al. | 99/355 |
| 3,397,817 | 8/1968 | Smith | 219/10.55 A |
| 3,534,676 | 10/1970 | Rubino | 99/355 |
| 3,884,213 | 5/1975 | Smith | 219/400 |
| 4,004,712 | 1/1977 | Pond | 219/10.55 B |
| 4,154,861 | 5/1979 | Smith | 426/466 |
| 4,289,792 | 9/1981 | Smith | 426/241 |
| 4,398,651 | 8/1983 | Kumpfer | 219/10.55 R |
| 4,409,453 | 10/1983 | Smith | 219/10.55 A |
| 4,592,485 | 6/1986 | Anderson et al. | 219/10.55 R |
| 4,762,250 | 8/1988 | Fiberg | 221/123 |
| 4,783,582 | 11/1988 | Wada et al. | 219/10.55 R |
| 4,784,292 | 11/1988 | Johndrow et al. | 99/357 |
| 4,835,351 | 5/1989 | Smith et al. | 219/10.55 R |
| 5,147,994 | 9/1992 | Smith et al. | 219/10.55 R |
| 5,210,387 | 5/1993 | Smith et al. | 219/10.55 M |
| 5,310,978 | 5/1994 | Smith et al. | 219/681 |
| 5,401,940 | 3/1995 | Smith et al. | 219/679 |

*Primary Examiner*—Tu B. Hoang
*Attorney, Agent, or Firm*—Sidley & Austin

[57] ABSTRACT

A combination microwave and air impingement oven has two magnetrons and an air handling system that includes two or more reciprocating ducts through which air is dispensed into the oven. The rotating ducts are configured to stir microwave energy in the oven to prevent formation of hot spots and to sweep microwave radiation over the surface of the food product. A foraminous partition, configured to encircle a portion of the cooking chamber, has a central portion and extremities mounted to divide the interior of the cabinet into a cooking chamber and an air heating chamber. The partition extends around a major part of the periphery of the cooking chamber such that air is drawn along multiple paths toward side walls and toward the rear wall from the cooking chamber.

30 Claims, 13 Drawing Sheets

AIR DISPENSERS FOR MICROWAVE OVEN

CROSS REFERENCE TO RELATED APPLICATIONS

This application is a continuation-in-part of application Ser. No. 08/357,705, filed Dec. 16, 1994, (now U.S. Pat. No. 5,510,601) entitled "CONVECTION HEAT TRANSFER APPARATUS," and a divisional of application Ser. No. 07/958,968, filed Oct. 9, 1992, (now U.S. Pat. No. 5,401,940, issued Mar. 28, 1995) entitled "OSCILLATING AIR DISPENSERS FOR MICROWAVE OVEN" which is a continuation-in-part of application Ser. No. 07/723,250, filed Jun. 28, 1991, (now U.S. Pat. No. 5,210,387, issued May 11, 1993) entitled "FOOD HANDLING SYSTEM", and a continuation-in-part of application Ser. No. 07/463,279 filed Jan. 10, 1990, entitled "MICROWAVE VENDING MACHINE," now U.S. Pat. No. 5,147,994, issued Sep. 15, 1992.

TECHNICAL FIELD

The invention relates to improvements in recirculating air convection microwave ovens for heating food products.

BACKGROUND OF INVENTION

In heavy duty foodservice ovens and food vending machines, cleaning is a major consideration. This is particularly important in air recirculating impingement ovens of the type disclosed in U.S. Pat. No. 3,884,213 and in convection ovens with microwave food heating.

U.S. Pat. No. 3,884,213 discloses an oven equipped with a pivotally mounted, rectangular shaped, microwave transparent plate having spaced tubes extending therethrough for forming collimated jets of air that are projected to impinge upon surfaces of a food product. While the disclosed oven provided significant improvements in the transfer of heat to the food product, it was difficult to clean and maintain. Further, the shape and mounting for the jet plate did not permit optimum air flow to provide maximum efficiency and required that the jet plate be microwave transparent.

Microwave heating of certain foods, including pizza and sandwiches that contain dough and bakery products, typically leaves the surface too moist and less palatable than similar food products cooked in other types of ovens.

Ovens of the type disclosed in U.S. Pat. No. 3,884,213; U.S. Pat. No. 4,154,861; U.S. Pat. No. 4,289,792; U.S. Pat. No. 4,409,453 and U.S. Pat. No. 4,835,351 employ air jets which impinge upon the surface of a food product to provide surface heating of the product in combination with microwave heating.

Jet impingement ovens have enjoyed significant success in commercial foodservice and commercial food processing operations. However, a long felt need exists for apparatus for quickly and efficiently heating food products that require little or no preparation for use in a vending machine for hot meals and in counter top ovens for food service operations that are easily cleaned.

U.S. Pat. No. 4,431,889 discloses a combination microwave and convection oven in which a gas burner positioned outside the oven provides heated combustion products which are drawn from the burner area along with vapor from an outlet of the oven by a blower system and the combined output of the blower system is blown into the oven through an oven inlet region in the oven wall. Both the oven outlets and the oven inlet are formed of holes substantially less than one-half wavelength in diameter. A predetermined portion of the blower output is blown through an exhaust vent thereby creating slight negative pressures in the oven and in the burner plenum to control the air flow through the burner.

U.S. Pat. No. 4,431,888 discloses a microwave oven having a directional rotating antenna axially supported on an axis of one wall of a microwave oven cavity of the microwave oven to provide circularly symmetric uniform energy distribution of microwave energy within the microwave oven cavity and consistent heating of a product in the microwave oven cavity. The directional rotating antenna includes a two-by-two array of antenna elements where each element is an end driven half-wavelength resonating antenna element supported by a length of conductor perpendicular to the wall of the microwave oven cavity. A parallel plate transmission line connects to each of the supports, four of which join at a junction which connects to a cylindrical probe antenna. The probe antenna is excited by microwave frequency currents of a waveguide adjacent to the wall of the microwave oven cavity.

The directional antenna is rotated by a moving stream of air circulated through the microwave oven cavity. A dome having a flattened conical shape extending outwardly in the wall of the microwave oven cavity provides a nearly circular recess partially surrounding the directional rotating antenna and provides uniform energy distribution in the product being heated. The dome returns microwave energy reflected from the product towards a circular area in the middle area of the microwave oven cavity. A transition section extends between the top of the dome and the one wall of the microwave oven cavity. The waveguide including three sides affixes to the outside wall of the dome, the transition section, and an extension of the wall extending beyond the microwave oven cavity which supports the microwave power source, all of which comprise the fourth wall of the waveguide. The microwave oven provides a consistent cooking pattern, especially for sensitive foods by utilizing high power of the microwave power source.

U.S. Pat. No. 4,940,869 discloses a cooking oven having both conventional heating and microwave heating. The oven muffle includes a metal distribution sheet along a backwall, forming a cavity with the backwall. A bladed turbine fan is in the cavity, is driven by an electric motor. Microwave energy is introduced into the cavity through a waveguide having an exit iris in the cavity. Microwave energy entering the cavity exits through openings in the metallic distribution sheet, as well as past the rotating turbine blade through additional holes in the distribution sheet. The microwave energy exiting the distribution plate is intended to provide for a better cooking energy distribution throughout the oven.

A long felt need exists for a microwave oven that is capable of quickly and uniformly heating food products which provides improved surface texture and crispness.

SUMMARY OF INVENTION

A preferred embodiment of the apparatus to transfer heat between streams of recirculating air and a food product includes an oven cabinet having an interior divided by a foraminous plate to prevent transfer of microwave energy from a cooking chamber to an air heating chamber in the cabinet. The air conditioning chamber houses air circulating apparatus to recirculate temperature controlled air from the air heating chamber through the cooking chamber to facilitate crisping and browning to provide a desired surface texture. The foraminous partition has extremities spaced from and extending along sides of the oven such that recirculating air is drawn along multiple paths to the air circulating apparatus.

Microwave heating apparatus communicates with the cooking chamber to provide rapid heating of the food by electromagnetic excitation. Air dispensing ducts are mounted by a coupling which permits oscillation of the ducts about axes to diffuse microwaves in the cooking chamber and to sweep collimated air streams across the surface of the food product.

In one embodiment of the invention, a method for controlling the temperature and surface texture of a product includes the steps of: positioning a product in a container having upwardly extending sides and a bottom; positioning the product and container in a temperature controlled atmosphere; supporting the product above the bottom of the container; and forming a region of controlled air pressure alternately adjacent opposite sides of the product by directing air to flow alternately adjacent opposite sides of the product such that temperature controlled air flows between the lower surface of the product and the bottom of the container.

DESCRIPTION OF DRAWINGS

Drawings of two preferred embodiments of the invention are annexed hereto so that the invention may be better and more fully understood, in which.

Numeral references are employed to designate like parts throughout the various figures of the drawing.

DESCRIPTION OF PREFERRED EMBODIMENTS

Figure 1:
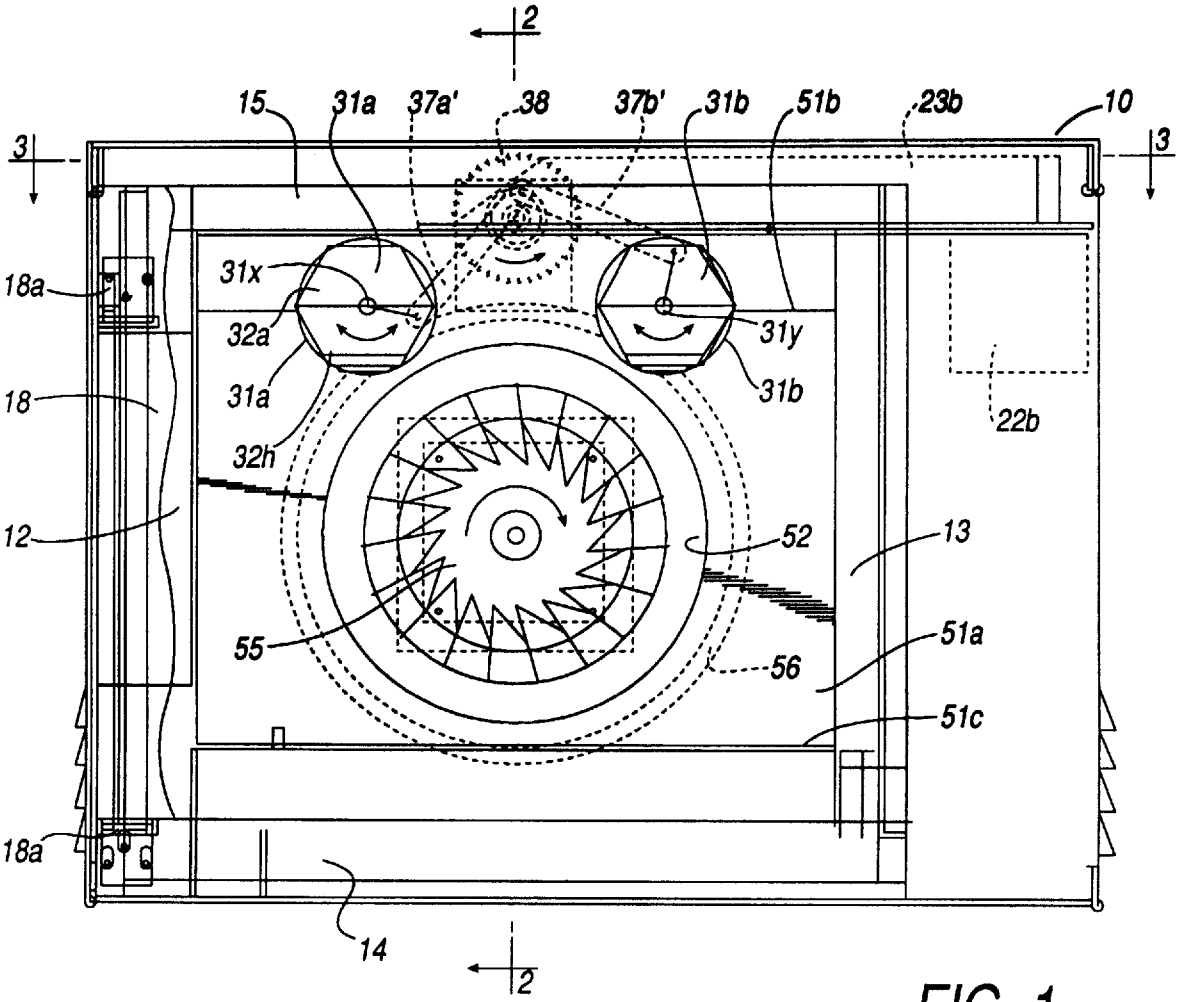
FIG. 1 is a front elevational view of a first embodiment of the oven, parts being broken away to more clearly illustrate details of construction.

Two embodiments of the improved microwave oven are illustrated in the drawings. In the first embodiment of FIGS. 1–10, an air heating chamber 40 is positioned behind a cooking chamber 30. In the embodiment of FIGS. 11–17, the air heating chamber is positioned above the cooking chamber.

Temperature controlled air is delivered into a duct, having a surface formed of microwave reflective material, for dispensing a stream of air from the duct into the cooking chamber. The duct is reciprocated such that the microwave reflective surface on the duct reflects and distributes microwave energy in the cooking chamber.

As will be hereinafter more fully explained, a source of electromagnetic radiation and air circulating apparatus are employed for heating a food product. In the illustrated embodiments, the food products may, for example, include french fried potatoes, chicken nuggets, pizza, submarine sandwiches, bread and other baking products.

DESCRIPTION OF A FIRST EMBODIMENT

A first embodiment of the oven is illustrated in FIGS. 1–10 of the drawings.

Figure 2:
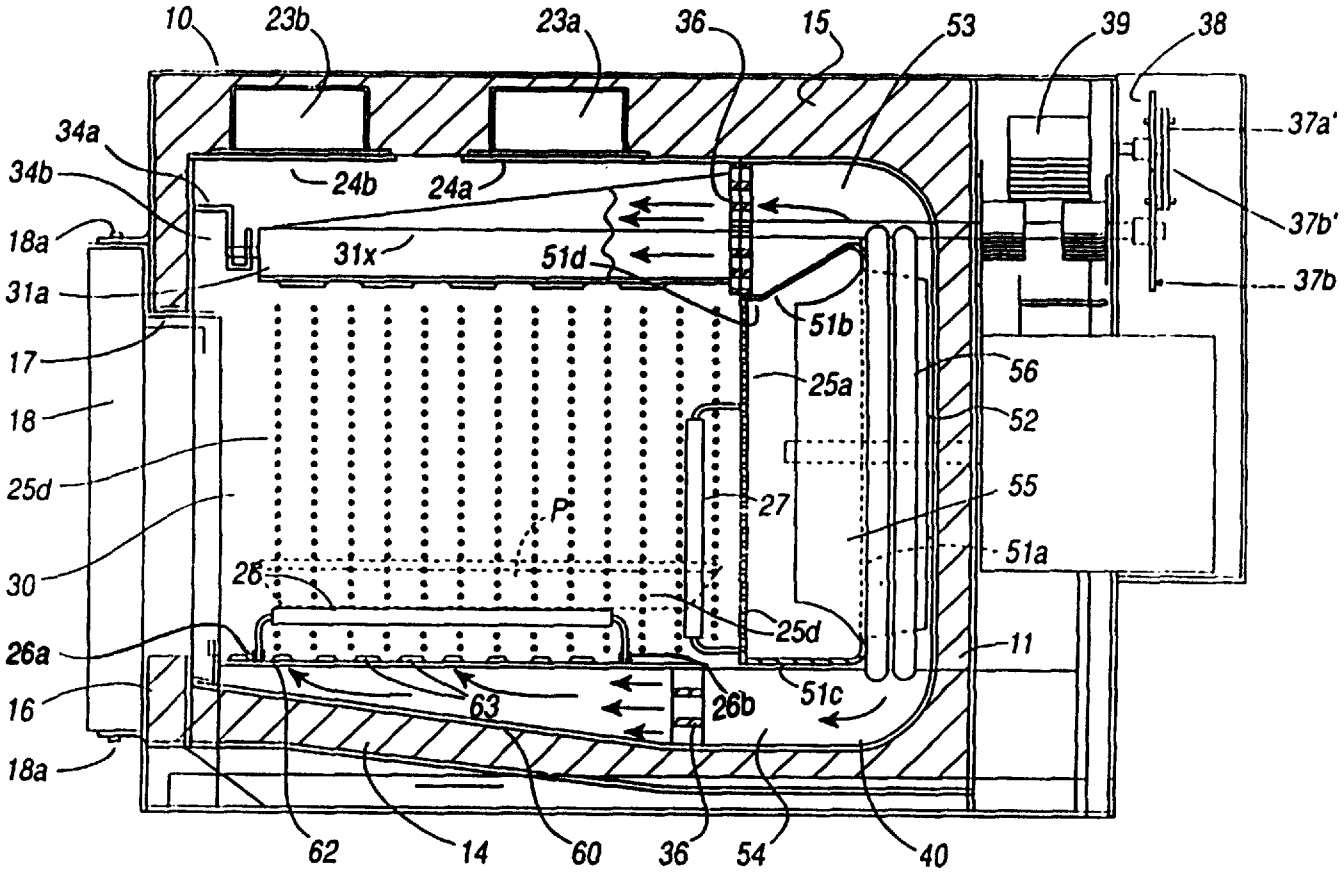
FIG. 2 is a cross-sectional view taken along line 2—2 of FIG. 1.
Figure 3:
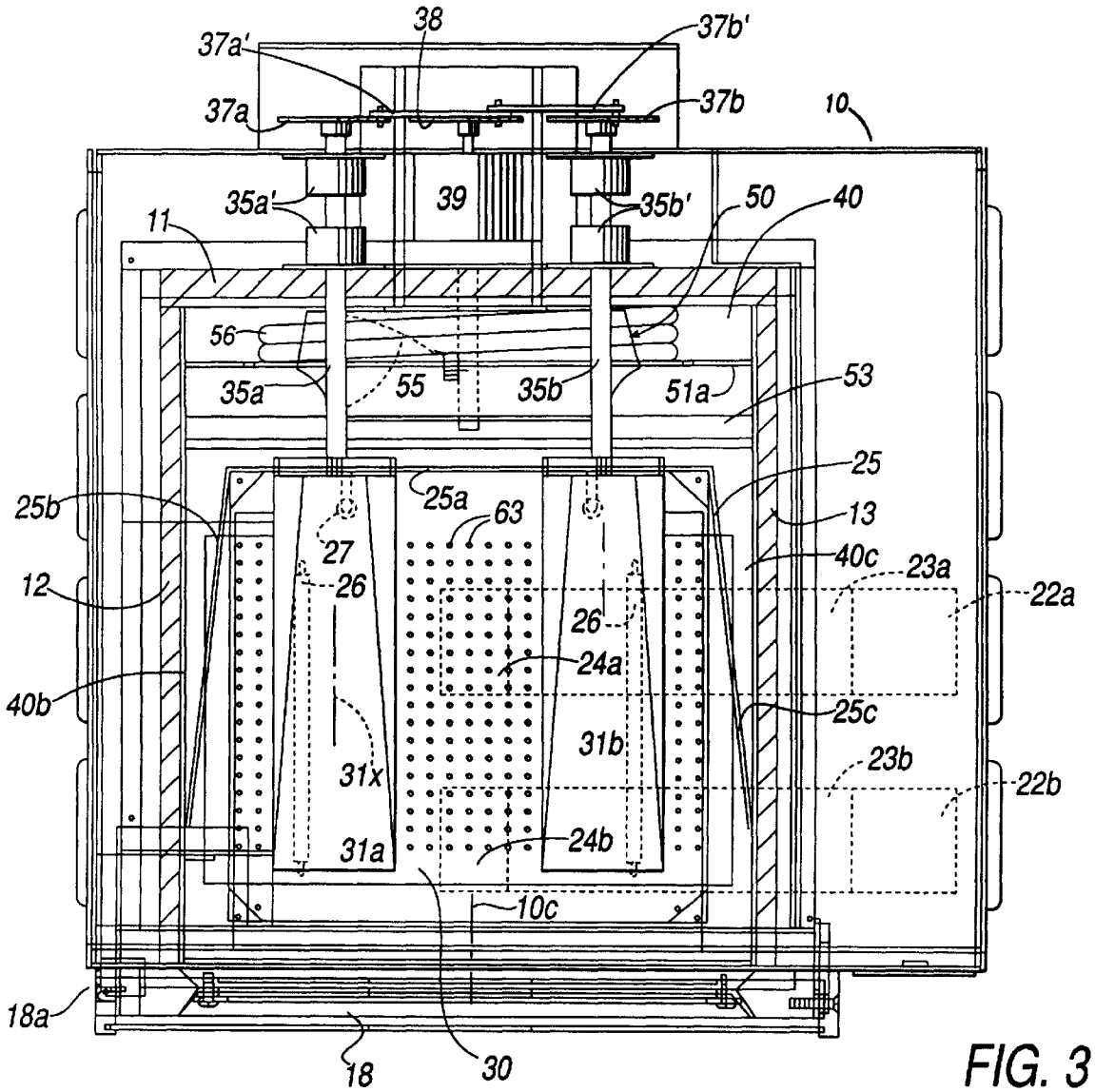
FIG. 3 is a cross-sectional view taken along line 3—3 of FIG. 1.

Referring to FIGS. 1, 2 and 3 of the drawing, oven 10 has a housing formed by rear wall 11, space side walls 12 and 13, bottom wall 14, top wall 15 and front wall 16. Front wall 16 has an opening 17 closed by a door 18 connected by hinges 18*a* to the front wall 16. A microwave trap is formed around door 18 to prevent passage of microwave energy through space around the door.

Magnetrons 22*a* and 22*b*, best illustrated in FIG. 3, are connected to wave guides 23*a* and 23*b* extending horizontally across an upper portion of the oven. As best illustrated in FIGS. 2 and 3 of the drawing, openings 24*a* and 24*b* are formed in the top wall 15 of oven 10 through which microwave energy is radiated into a cooking chamber 30, as will be hereinafter more fully explained.

Referring to FIG. 3 of the drawing, a perforated partition 25 divides the interior of oven 10 to form a cooking chamber 30 and a heating chamber 40. The perforated partition 25, constructed of metallic or other electrically conductive material having perforations with relatively small openings 25*d* equivalent to more than about 40% and preferably less than about 60% of the surface area of partition 25, is configured to prevent passage of microwave energy from the cooking chamber 30 into said air heating chamber 40. Partition 25 has a central portion 25*a* and extremities 25*b* and 25*c* configured to encircle a portion of the cooking chamber 30 such that heating chamber 40 is spaced horizontally from cooking chamber 30. Heating chamber 40 is in a back portion of the oven and has legs 40*b* and 40*c* extending along opposite sides of the cooking chamber 30. It should be appreciated that the foraminous partition 25 extends around a major portion of the periphery of cooking chamber 30. As will be hereinafter more fully explained, air is drawn along multiple paths toward side walls 12 and 13 and toward rear wall 11 from cooking chamber 30 to minimize interference of spent air drawn through openings in the partition 25 with air streams dispensed into the cooking chamber 30 through air dispensers 31*a* and 31*b*.

As best illustrated in FIG. 3, opening 24*b* is formed in top wall 15 adjacent the door 18 and is positioned substantially equal distances between side walls 12 and 13. Opening 24*a* extends through top wall 15 rearwardly of opening 24*b* and wave guides 23*a* and 23*b* are positioned generally parallel to each other in the illustrated first embodiment.

The magnetrons 22*a* and 22*b* are mounted adjacent side wall 13 of the oven, in the illustrated embodiment, and deliver microwave energy through horizontally disposed wave guides 23*a* and 23*b,* extending perpendicular to the centerline 10*c* of the oven, and through outlets 24*a* and 24*b* into the cooking chamber 30. It should be appreciated that magnetrons 22*a* and 22*b* may be mounted in the rear of the oven or one in the rear and one at a side of the oven.

Microwave energy traveling through a wave guide into a microwave cooking cavity tends to form hot spots in the cooking chamber. Microwave ovens are generally provided with a turntable to move the food product or with a stirrer to move the hot spots around the oven in an attempt to prevent over heating of portions of the food product.

Referring to FIG. 2, a plurality of horizontal rails 26 and vertical bumpers 27 are provided to support a pan P or wire grills (not shown) for food products. Plastic tubing of for example about 30/1000 inch wall thickness on metal rods form a non-conductive support to prevent arcing between the pans and oven walls. It should be appreciated that ceramic materials or other non-conductive coatings could be used to prevent arching.

Pans resting on the surface of insulated rails 26 need not be perfectly flat to prevent forming critical gaps which would cause arcing. Rails 26 are supported by rail legs 26*a* and 26*b*. The length of legs 26*a* and 26*b* controls spacing between the bottom of the pan P and a bottom jet forming plate 62 and consequently the intensity of heat transferred to the bottom of pan P. In the illustrated embodiment, the length of each leg 26*a* and 26*b* is adjustable by rotating a threaded foot that extends into an internally threaded tubular leg. Other and further height adjusters, such as racks slidable in vertically spaced notches (not shown), may be employed.

Referring to FIGS. 2 and 3 of the drawing, air circulating apparatus, generally designated by the numeral 50, comprises a blower housing, formed between rear wall 11 and a plenum wall 51, that has upper and lower discharge openings 53 and 54 which extend horizontally above and below a radial flow fan impeller 55. A heating element 56 is mounted adjacent to or in the fan housing. While a radial flow fan is illustrated in the preferred embodiment, it should be appreciated that other impellers, such as axial flow fans, may be used, if it is deemed expedient to do so.

The discharge openings 53 and 54 are formed by a plenum wall 51 extending generally parallel to rear wall 11. Plenum wall 51 has a generally vertically extending central portion 51a and generally horizontally extending upper and lower portions 51*b* and 51*c,* respectively. The central portion 51*a* has an opening 52 in which radial flow fan 55 is mounted.

A pair of generally circular tubular members 51*d* extend outwardly from spaced openings in the upper portion of the plenum wall and telescopically extend into circular sleeves 34 formed on air dispensing ducts 31*a* and 31*b* which oscillate about spaced axes 31*x* and 31*y,* as will be hereinafter more fully explained.

Referring to FIGS. 4–8, each of the air dispensing ducts 31*a* and 31*b* comprises a body portion 32 having a tapered longitudinal cross-section formed between spaced panels 32*a,* 32*b,* 32*c,* 32*d,* 32*e* and 32*f* having microwave reflective surfaces. Panels 32*a*–32*f* are angularly inclined to form a duct having a hexagonal shaped lateral cross-section in the illustrated embodiment. However, it is contemplated that other geometrically shaped cross-sections may be employed. Panels 32*a* and 32*d* on opposite sides of duct 31 are not parallel so that the duct is tapered along its length. An end wall 32*h* closes the outer end of the duct 31*a*.

Air dispensing ducts 31*a* and 31*b* are of substantially identical construction and are preferably interchangeable. Each duct 31 may be formed of two pieces of flat sheet metal. A first piece is bent to form panels 32*a,* 32*b* and 32*f*. A second piece is bent to form panels 32*c,* 32*d* and 32*e* and end wall 32*h*. After apertures 33 are formed in panel 32*d,* the two pieces are welded or otherwise connected.

Figure 4:
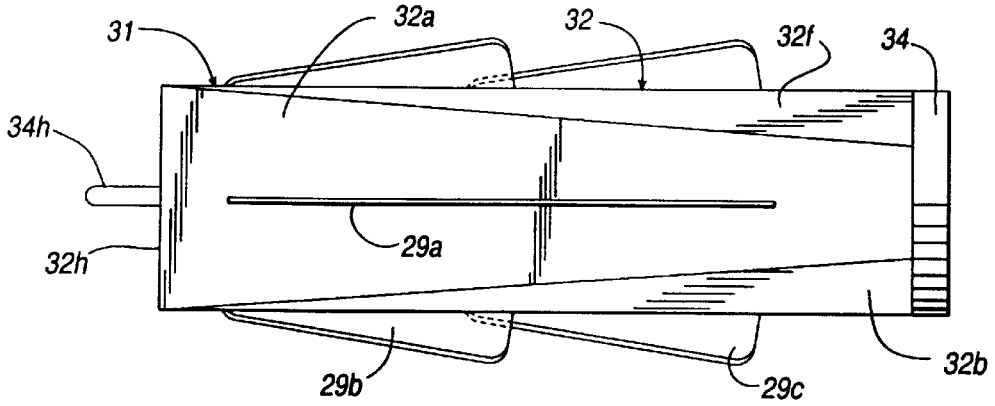
FIG. 4 is a top plan view of an air dispensing duct.
Figure 5:
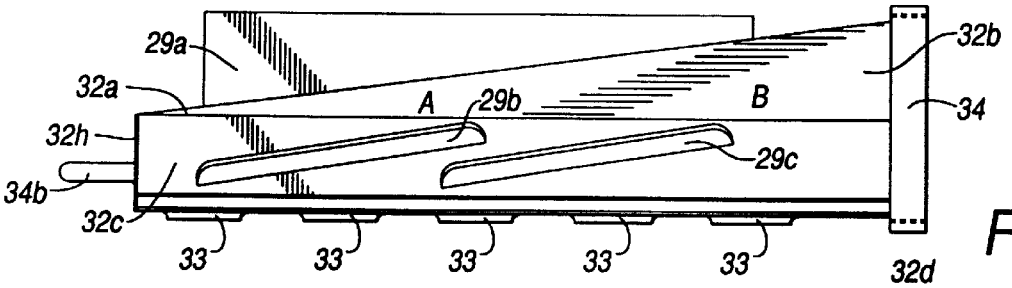
FIG. 5 is a side elevational view thereof.
Figure 6:
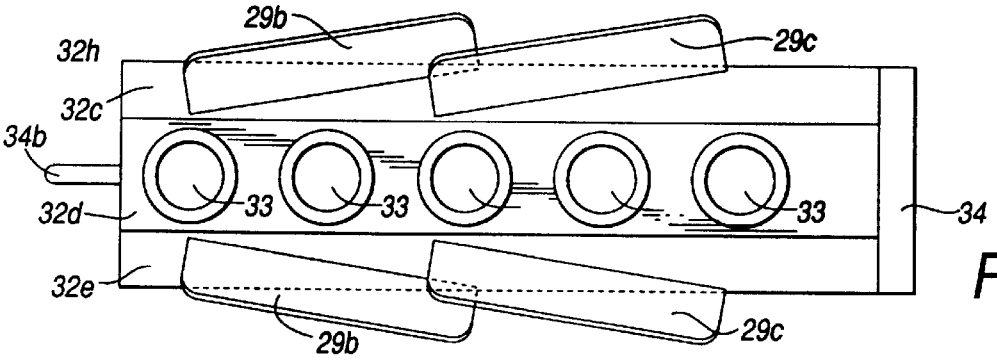
FIG. 6 is a bottom plan view of the air dispensing duct.
Figure 7:
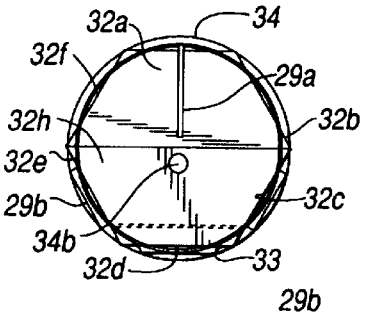
FIG. 7 is an end view of the duct.

A fin 29*a,* best illustrated in FIGS. 4, 5 and 7, is secured to panel 32*a* in the illustrated embodiment to reflect microwave. Additional fins 29*b* and 29*c* on panel 32*c* and on panel 32*e* also facilitate stirring the microwave.

Panel 32*d* has a plurality of spaced apertures 33 formed therein and a flange or sleeve 34 on the inlet end of the tapered duct 31 is configured to be telescopically positioned in the tubular member 51*d* which forms an outlet from plenum 53, as illustrated in FIG. 2. The air dispensers 31*a* and 31*b* are pivotally secured to tubular members 51*d* and outer ends are pivotally supported by a pivot pin 34*b* extending through an aperture in hanger 34*a,* as best illustrated in FIG. 2 of the drawing.

Figure 8:
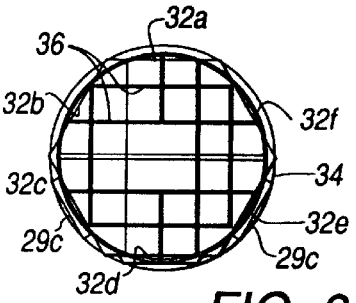
FIG. 8 is an elevational view of the inlet end of the air dispensing duct.

As illustrated in FIGS. 2 and 8 of the drawing, air directing vanes 36 form a grid inside sleeves 34 for distributing air along the length of the interior of each of two or more tapered ducts 31.

Shafts 35*a* and 35*b,* having slots formed in ends thereof, extend through openings in rear wall 11 of oven 10 and are supported in bearings 35*a*' and 35*b*', as illustrated in FIG. 3. One of the air directing vanes 36 extends into the slot in the end of shaft 35*a* or 35*b* to form a quick release coupling for removably securing ducts 31*a* and 31*b* to the shafts 35*a* and 35*b*. It should be readily apparent that this quick release coupling facilitates removing ducts 31*a* and 31*b* for cleaning and also provides a significant control of the heat treatment of the food product.

If the oven is to be configured for jet impingement heat transfer to the food product, ducts 31*a* and 31*b* are positioned to direct air streams downwardly toward the bottom wall 14 of oven 10. However, if the oven is to be configured for convection heat transfer, ducts 31*a* and 31*b* would be rotated, for example 180 degrees from the illustrated position, relative to shafts 35*a* and 35*b* to direct air streams upwardly toward the top wall 15 of oven 10.

Air directing vanes 36 are configured to deliver temperature controlled air into the duct substantially parallel to a longitudinal axis 31*x* or 31*y* of ducts 31*a* or 31*b*. Streams of air are directed transversely of the axis 31*x* or 31*y* from each air dispensing duct 31*a* or 31*b* toward the food product or away from the food product, depending on the mounting of the ducts 31*a* and 31*b* on shafts 35*a* and 35*b*. As the duct 31*a* reciprocates about the axis 31*x* of pin 34*b,* which is parallel to the axis 31*x* of the duct, streams of air formed by apertures 33 impinge on discrete areas on the surface of the food product to transfer heat between the air streams and the surface of the food product.

As best illustrated in FIGS. 1, 2 and 3 of the drawing, disks 37*a* and 37*b* are mounted on the outer ends of shafts 35*a* and 35*b*. A disk 38, mounted on the shaft of a motor 39, is connected through connector links 37*a*' and 37*b*' to disks 37*a* and 37*b* on shafts 35*a* and 35*b*. As disk 38 rotates, connector links 37*a*' and 37*b*' impart oscillatory motion to the ducts 31*a* and 31*b*.

From the foregoing it should be readily apparent that motor 39 rotates drive disk 38 which imparts reciprocating motion through links 37*a*' and 37*b*' to disks 37*a* and 37*b* mounted on shafts 35*a* and 35*b*. Each disk 37*a* and 37*b* oscillates, as diagrammatically illustrated in FIG. 9, between opposite extremes of a range of motion. Connector links 37*a*' and 37*b*' are preferably connected to disks 37*a* and 37*b* at locations spaced ninety degrees apart such that ducts 31*a* and 31*b* oscillate as illustrated in FIG. 10 of the drawing.

Figure 9:
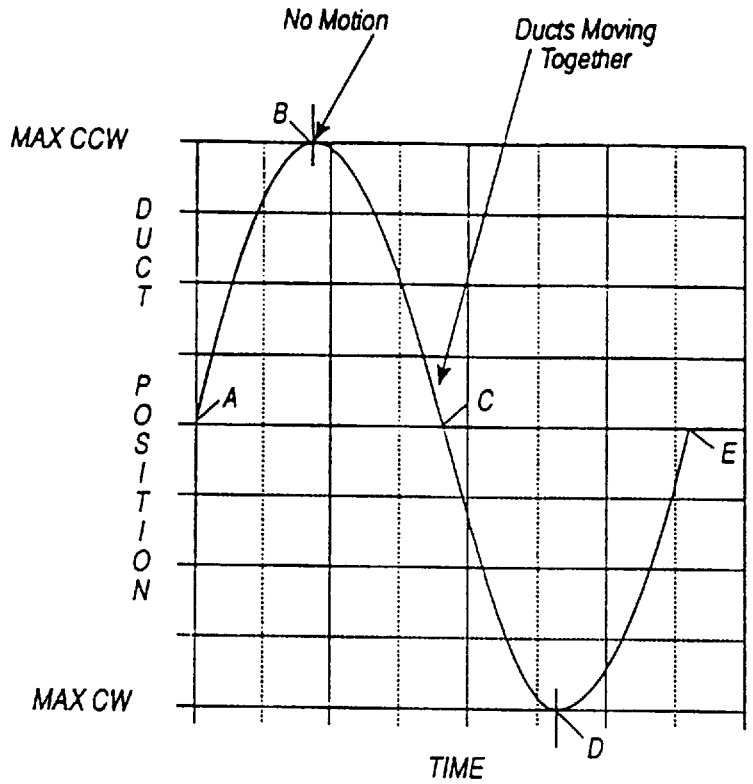
FIG. 9 is a graph diagrammatically illustrating the velocity of an oscillating air dispensing duct through a full range of movement.

Referring to FIG. 9 of the drawing, the sine wave graph illustrates the oscillating motion of each duct 31*a* and 31*b*. At position "A" on the graph in FIG. 9 finger 31*a* is positioned such that orifices 33 are directly below the centerline or axis 31*x* and moving at maximum velocity. At point "B", duct 31*a* has rotated to the end of its cycle and has stopped momentarily while it changes directions. At point "C" duct 31*a* is moving in the opposite direction from that of point "A" at its maximum velocity. At point "D" duct 31*a* has reached the other extreme of its range of movement and has stopped momentarily while it changes direction. At point "E" duct 31*a* has returned to a point corresponding to point "A" where it began its cycle of oscillation.

If ducts 31*a* and 31*b* were connected to move in synchronized relation, each duct would move according to the sinusoidal graph of FIG. 9.

Figure 10:
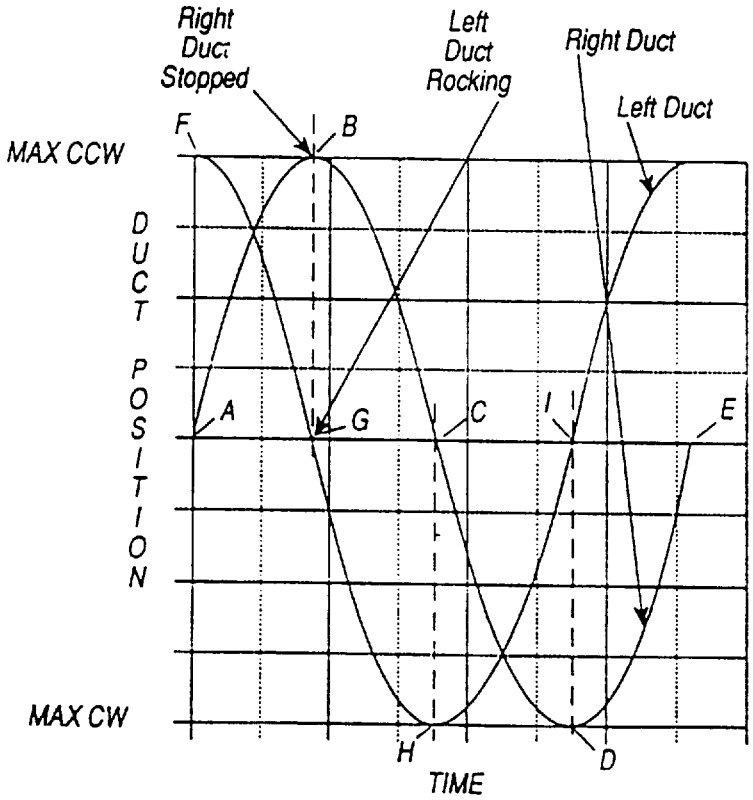
FIG. 10 is a graphic illustration of multiple air dispensing ducts moving asynchronously.

Referring to FIG. 10, when connector links 37*a*' and 37*b*' are positioned 90° apart relative to disc 37*a* and disc 37*b*, the second air dispensing duct 31*b* is at point "F" while the first air dispensing duct 31*a* is at point "A". Thus, when duct 31*a* is moving at its maximum velocity at point "A" duct 31*b* is momentarily stopped and changing directions at point "F". When duct 35*a* reaches point "B" where it momentarily stops to change directions, duct 35*b* is moving at its maximum velocity through point "G".

When connector links 37*a*' and 37*b*' are connected 90° apart on disc 37*a* and 37*b*, the relative movement of ducts 31*a* and 31*b* is substantially as illustrated in FIG. 10 of the drawing. By advancing one of the connector links 31*a*' or 31*b*' relative to the other, the point "F" in FIG. 10 can be advanced relative to point "A" on the graph. Further, it should be readily apparent that disc 37*a* and 37*b* may be replaced by cranks or other suitable force transmitting mechanisms. Further, connector links 37*a*' and 37*b*' may be replaced by chains, timing belts or the like for providing a driving force. In addition, each shaft 35*a* and 35*b* may be driven by separate motors (not shown)

If ducts 31*a* and 31*b* are rocked in synchronized relation and in phase, as illustrated in FIG. 9, at two points in the cycle both ducts are completely stopped which results in a deterioration of the microwave distribution. When ducts 31*a* and 31*b* are moved out of phase, an arrangement is provided that allows one of the ducts to always be in motion. If reflective surfaces 32*a*–32*f* on ducts 31*a* and 31*b* are asynchronous, the microwave field is being stirred at all times. There is no point in the cycle where there is a total lack of motion inside cooking chamber 30.

It should be appreciated that more than two ducts 31 may be employed for delivering air into the cooking chamber and driven such that the ducts oscillate in other relationships relative to each other.

The positioning of oscillating air dispensers 31*a* and 31*b* closely adjacent opposite sides of openings 24*a* and 24*b* through which microwave energy is delivered into the cooking chamber 30 stirs the microwave as the air dispensing ducts oscillate. Moving surfaces on the oscillating ducts 31*a* and 31*b* also change constantly to diffuse standing waves of reflected microwave energy in the cooking chamber. Any hot spots formed by the microwave energy in the cooking chamber are diffused by the oscillating ducts as the air streams are swept through the cooking chamber to provide more uniform heating by both the microwave energy and the impinging air streams.

A lower tapered duct 60, best illustrated in FIG. 2, which is significantly wider than the upper oscillating air dispensing ducts 31*a* and 31*b* delivers air streams upwardly through openings 63 formed in a plate 62 to impinge against the bottom of a pan P, shown in dashed outline in FIG. 2, or a product supported on a rack in the bottom of the oven.

From the foregoing it should be readily apparent that the apparatus hereinbefore described for transferring heat between temperature controlled air and a food product has multiple air dispensers 31*a* and 31*b*. Oscillation of multiple ducts 31*a* and 31*b* provides a more uniform sweeping action of air streams which project into the cooking chamber than could be accomplished with a single jet plate having apertures spaced across the entire length of the cooking chamber. The multiple air dispensers remain a substantially uniform distance from a food product in the cooking chamber as the air streams are moved across the surface of the food product.

The foraminous partition 25 having a configuration approximating that of the cooking chamber forms foraminous walls 25*a*, 25*b* and 25*c* around the food product for collecting any material which may splatter during the cooking process. Further, the foraminous walls 25*a*, 25*b* and 25*c* spaced from side walls 12 and 13 and rear wall 11 form a generally U-shaped air heating chamber 40 around the cooking chamber 30. Spent air flowing from the cooking chamber is drawn through openings in the foraminous side partition walls 25*b* and 25*c* and also through the central rear foraminous partition wall 25*a*. Thus, it should be readily apparent that air dispensed into the cooking chamber through the oscillating upper air dispensing ducts will be drawn away from opposite sides of the row of openings 33 formed in each air dispensing duct 31*a* and 31*b*. This minimizes the possibility that spent air will be drawn along a path which will wash out air streams dispensed from the air dispensing ducts.

Openings 33 in the upper air dispensing ducts 31*a* and 31*b* are preferably larger in diameter than the openings 63 formed in the lower air dispensing duct 60.

It has been observed that air delivered through an orifice can be projected a distance about eight times the diameter of the opening before it loses its integrity and significantly diffuses. In a preferred embodiment of the invention, openings 33 in the upper air dispensers are preferably, for example, about one inch in diameter and the upper surface of the food product is in a range between about two inches and eight inches from the lower surfaces of the oscillating ducts 31*a* and 31*b*.

Openings formed in the lower duct 60, in the illustrated embodiment, are configured to impinge against a lower pan surface constructed of thermally conducted material. Thus, the lower tapered duct 60 is provided with smaller openings 63 spaced closer together than those formed in the upper air dispensing ducts 31*a* and 31*b*. In a preferred embodiment, the lower tapered duct is provided with apertures 63 having a diameter of for example one-half inch and are positioned in a range between one and four inches of the bottom of the pan P supporting the food product.

In the illustrated embodiment, the pan P containing the food product does not move relative to the lower air dispensing duct 60.

In certain applications, if heat is not conducted by the pan away from spots upon which the lower jets impinge fast enough to provide substantially uniform heating to the bottom of the food product, either the lower duct 60 or the product support 26 may be moved relative to the other for sweeping air streams across the bottom surface of the pan P. If it is deemed expedient to do so, oscillating ducts directing air streams upwardly may replace the lower dispensing duct 60.

It should be readily apparent that the foraminous partition 25*a,* plenum wall 51 and the air directing vanes 36 inside each air dispensing duct 31*a* and 31*b* create zones of differential pressure throughout the oven compartment for enhancing and controlling air flow therethrough. The radial flow fan 55 draws air from the air heating chamber 30 creating an area of low pressure and delivers air into the upper and lower plenums 53 and 54 creating areas of high air pressure. The vanes 36 in the upper and lower air dispensing ducts 31*a* and 31*b* and in the lower air dispensing duct 60 create a slight back pressure in each air dispensing duct for maintaining substantially uniform air pressure longitudinally of each air dispensing duct even though openings 33 and 63 are formed in the air dispensing ducts.

Since the foraminous partition 25 extends around a substantial portion of the periphery of the cooking chamber 30, air is drawn along multiple paths away from the food product after the air streams impinge against the surface of the food product and diffuse. This allows the spent air to be expeditiously removed from the cooking chamber while minimizing diffusion of the air streams before they impinge upon the surface of the food product.

Further, the foraminous partition 25 is easily removable from the cooking chamber 30 when door 18 is opened for cleaning or replacement with a clean foraminous partition.

The shape and configuration of the foraminous partition 25 facilitates collection of splattered material and its position in the stream of recirculating air causes it to be maintained at a temperature which is lower than the temperature of other surfaces in the cooking chamber. It should be readily apparent that spent air which impinges against the surface of a cold food product will be at a lower temperature when it passes through the foraminous partition than air in the air stream which has been heated by the heating elements 56 in the air heating chamber 40 and delivered through the plenum to the air dispensing ducts 31*a* and 31*b.* Airborne particles and smoke in the circulating air tends to be collected on the coolest surfaces in the oven which in the illustrated embodiment are positioned for easy cleaning. This prevents transfer of airborne contaminants into the air heating chamber 40 for accumulation on surfaces which are difficult to clean.

As noted above, passages in the foraminous partition 25 are configured to prevent the transfer of microwave energy from the cooking chamber 30 into the air heating chamber 40 which significantly reduces the possibility of leakage of microwave energy through openings in the air heating chamber through which fan motor drive shafts, electrical conductors and the like extend.

Since microwave energy is contained in the cooking chamber and isolated from the air heating chamber, fresh air may be circulated through the air heating chamber 40 if it is deemed expedient to do so for removing smoke and eliminating rancid odors.

The transfer of heat between temperature controlled air and a food product is enhanced by delivering temperature controlled air, substantially parallel to an axis 31*x* in the embodiment of FIGS. 2 and 3 into the air dispensing duct because air is uniformly distributed and air pressure is substantially constant along the length of each duct. This improves the efficiency of the air flow for dispensing streams of air from the duct toward the food product in a direction generally transverse of axis 31*x* and generally perpendicular to the food surface.

Reciprocation of the duct about axis 31*x* sweeps the streams of air that impinge on discrete areas on the surface of the food product across the surface of the food product.

SECOND EMBODIMENT

The second embodiment of the oven, generally designated by the numeral 70, in FIGS. 11–20 of the drawing, comprises spaced side walls 72 and 74, a back wall 76 and a front wall 78. Front wall 78 has an access opening 79 formed therein which is opened or closed by a door 80. A microwave trap 81 is formed around door 80 and is configured to prevent passage of microwave energy through space between the periphery of the door 80 and walls of the cabinet 70. Top wall 71 and bottom wall 73 close upper and lower ends of oven 70. Each wall of the oven is preferably formed by spaced metallic sheets and the space between the sheets is filled with thermal insulation material.

A door actuator 82, secured to mounting bracket 82*a,* is connected through a link 84 to door 80 for moving door 80 vertically relative to access opening 79. The door actuator 82 is preferably an electro-mechanical actuator driven by a motor 82*c* or a pneumatically actuated cylinder (not shown).

Figure 11:
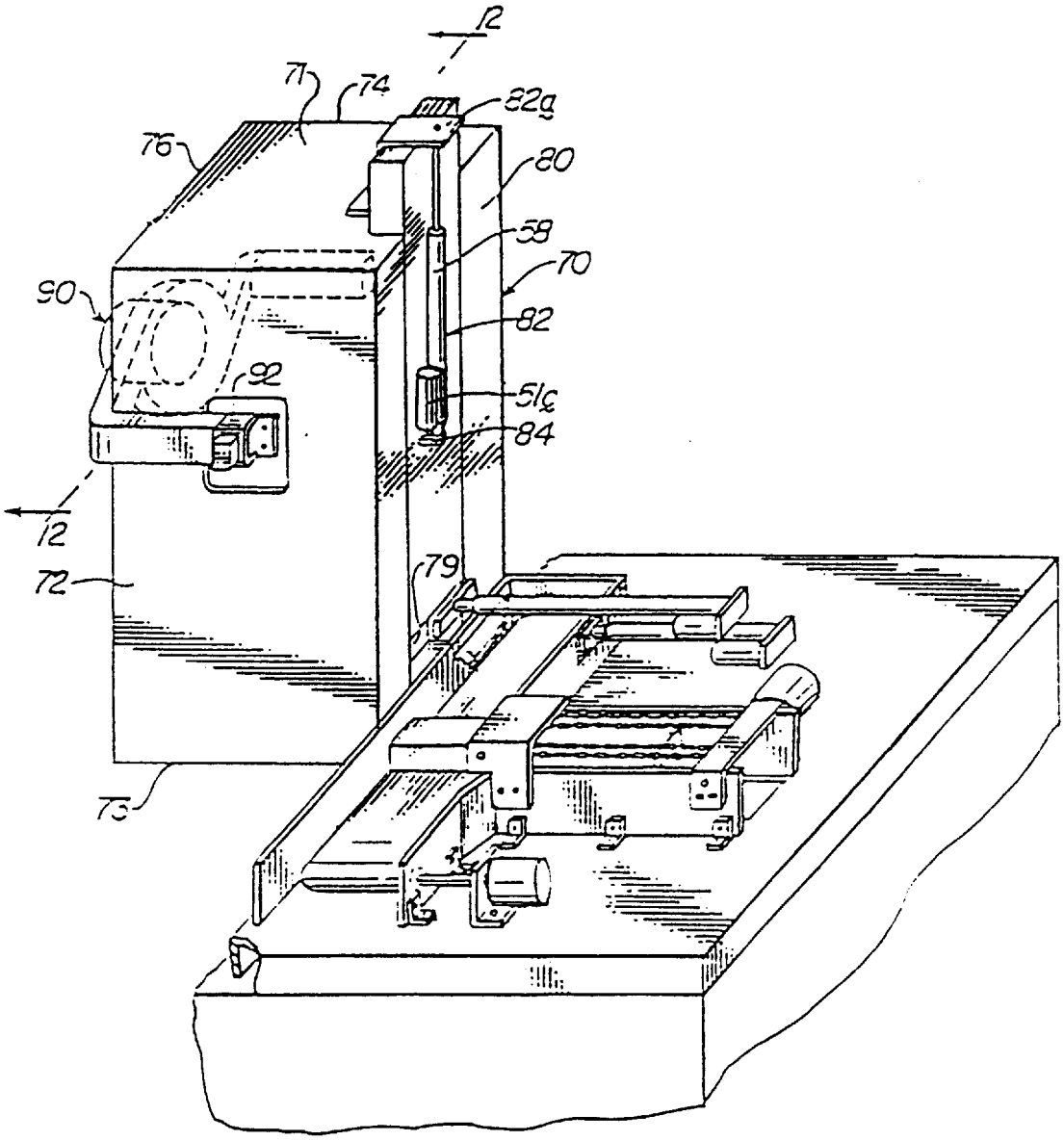
FIG. 11 is a perspective view of a second embodiment of a microwave oven including a package handling apparatus and oven cabinet inside a vending machine, the outer cabinet of the vending machine being broken away to more clearly illustrate details of construction.
Figure 12:
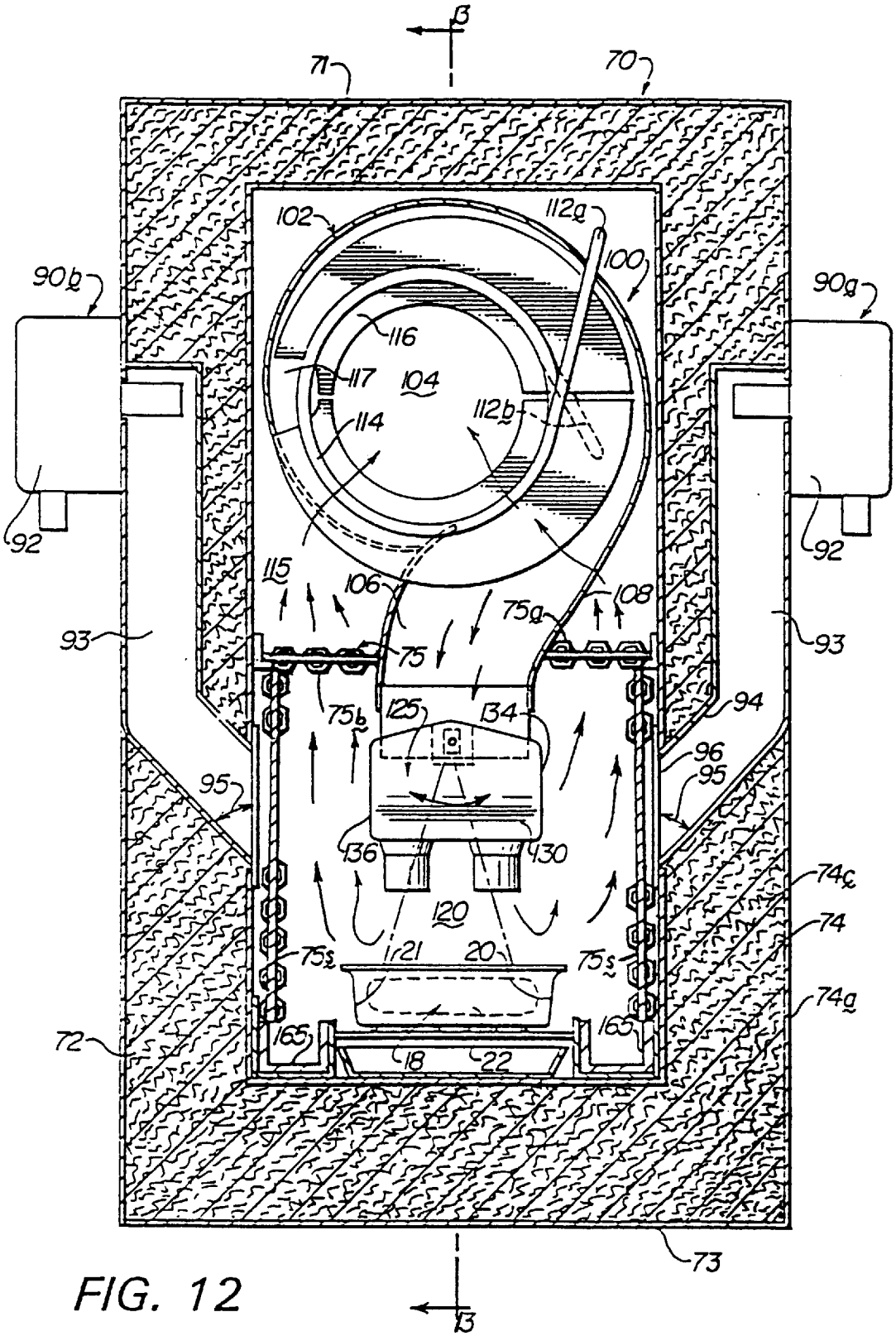
FIG. 12 is a cross-sectional view taken along line 12—12 of FIG. 11.

Referring to FIGS. 11 and 12 of the drawing, the electromagnetic radiation device generally designated by the numeral 90 in the illustrated embodiment comprise a pair of magnetrons 92 connected to wave guides 93 formed in side walls 72 and 74 of oven 70. The magnetrons 92 supply electro-magnetic energy to wave guides which carry the energy to the cooking chamber. Magnetrons 92 convert electrical energy to electromagnetic energy in the microwave frequency spectrum. Waves of microwave energy are similar to radio waves except they are higher frequency than radio waves and lower frequency than ordinary light waves. The microwave energy is channeled through wave guides 93 from the magnetrons 92 into the cooking chamber 120.

As illustrated in FIG. 12 of the drawing, the side walls 72 and 74 are formed by spaced sheets 74*a* and 74*b* and insulation material 74*c* is configured to form a guide tube 93 having a lower end 94 which is inclined at an angle 95 relative to a vertical plane 96 at an angle in a range between 15° and 75°. In the illustrated embodiment, the angle 95 is approximately 45°.

Figure 15:
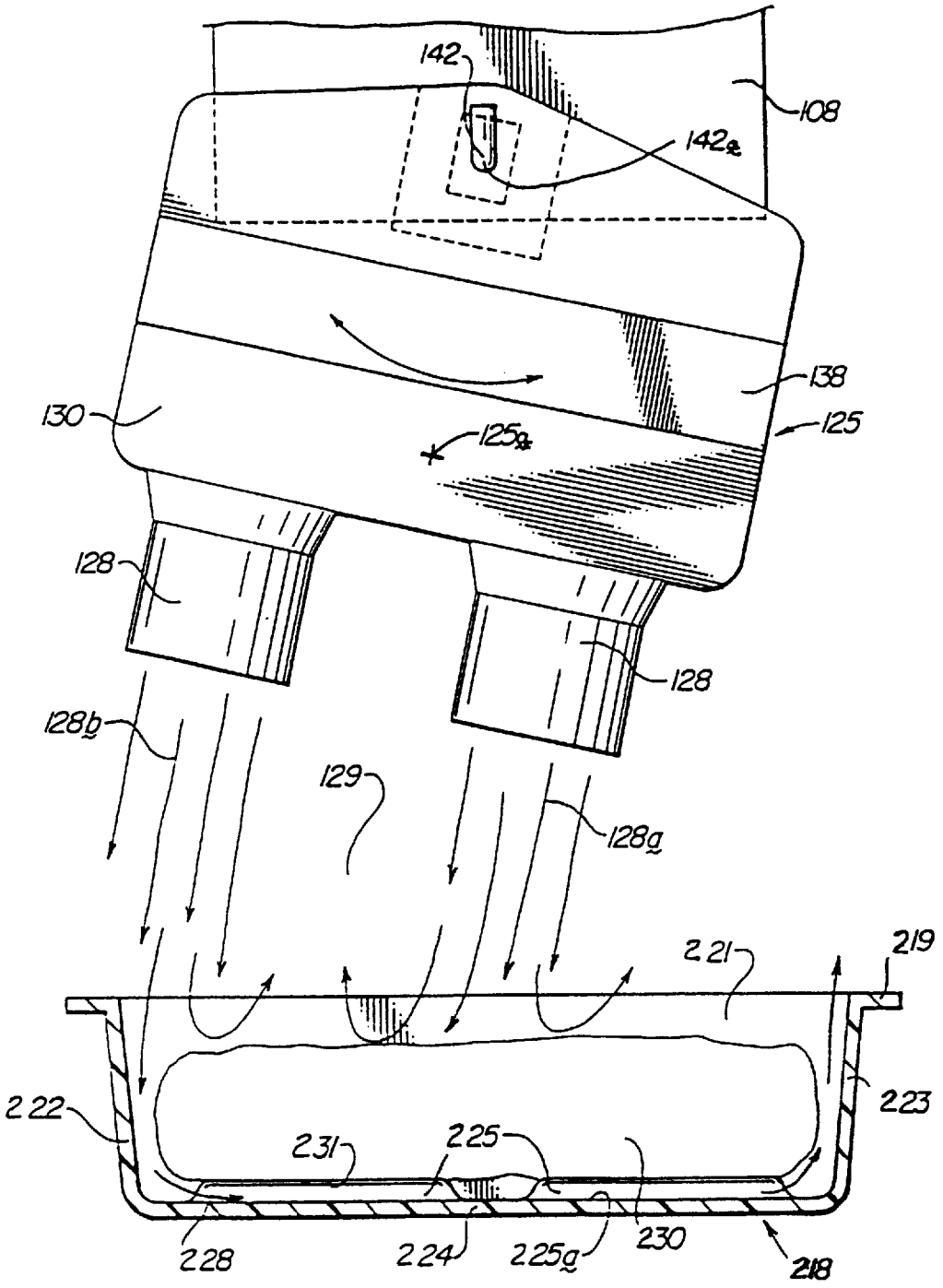
FIG. 15 is a diagrammatic view illustrating air flow during a first stage of the cooking process.
Figure 16:
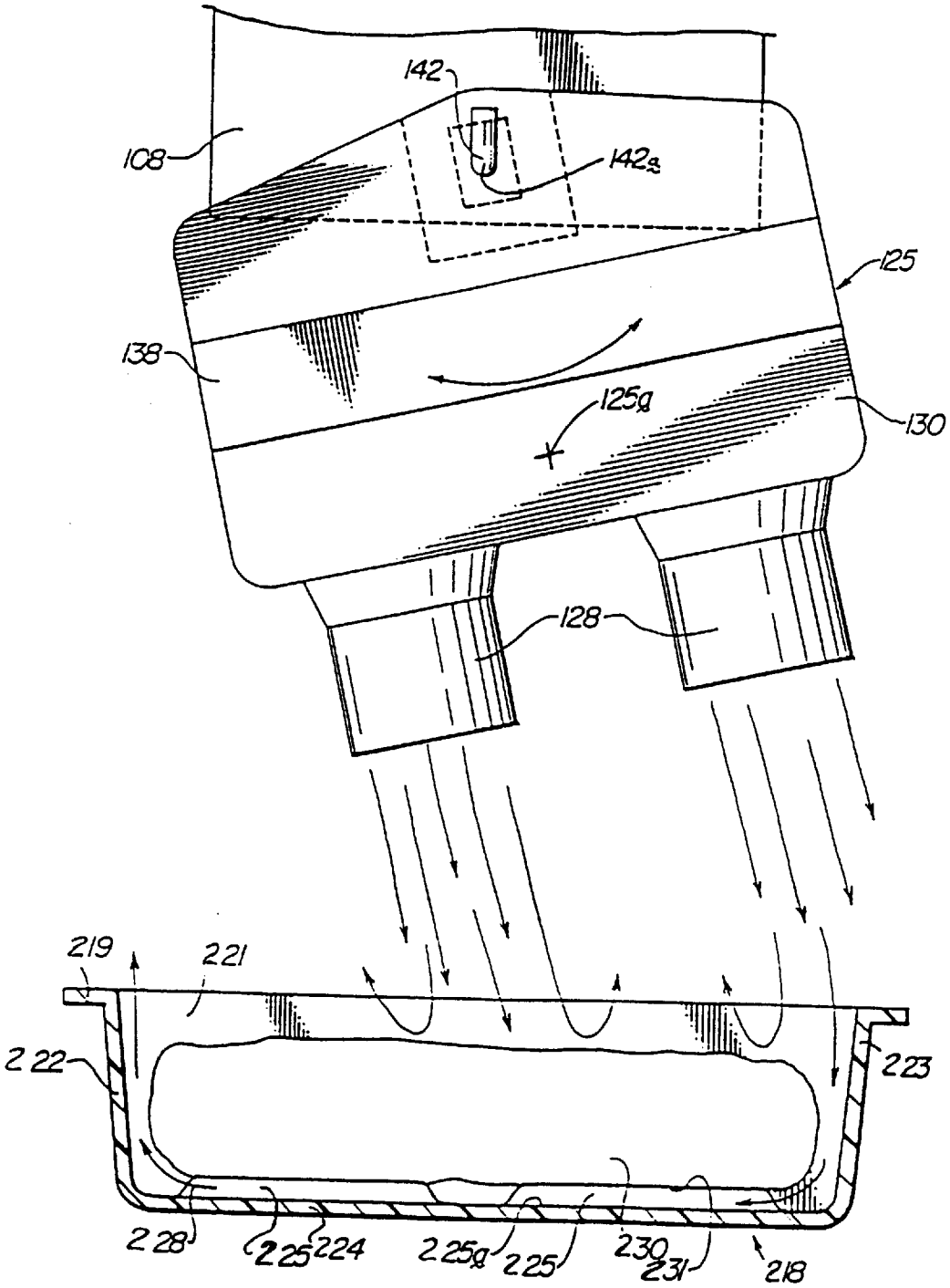
FIG. 16 is a diagrammatic view similar to FIG. 11 illustrating air flow during a second stage of the cooking process.
Figure 17:
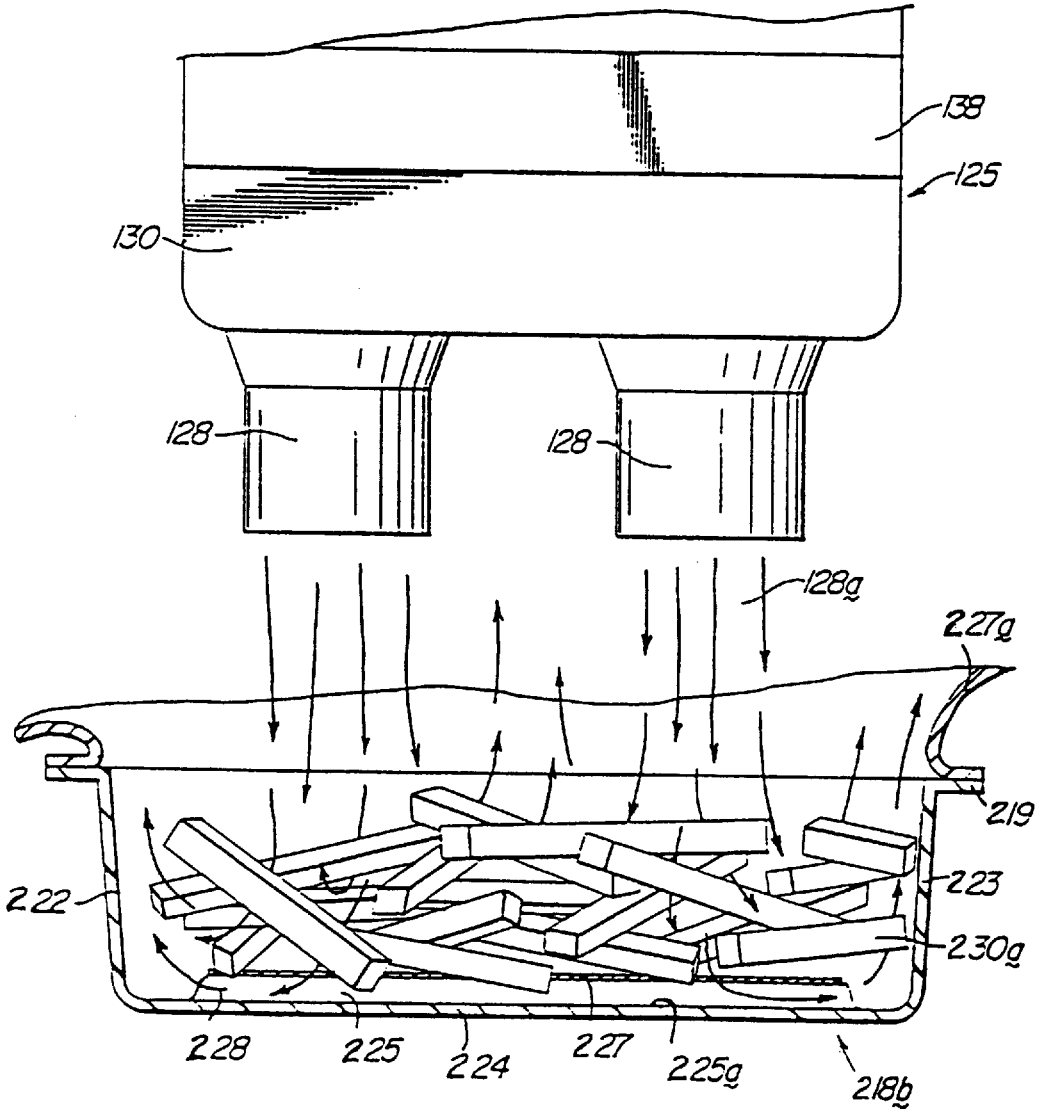
FIG. 17 is a diagrammatic view similar to FIG. 11 illustrating air flow through a particulate food product.

The application of microwave radiant heating is delivered from two sides and angles downwardly toward food 230 in an open top non-metallic container 218, as shown in FIG. 15. Since the non-metallic container 218 and the food in the container do not reflect microwaves significantly and since the space under the container diffuses microwave which passes through or by the container the beam from one wave guide is not reflected directly into the other but is largely retained in the heating chamber.

Since the container 218 is non-metallic, reflections from one wave guide 93 are not reflected into the other to keep microwave in the chamber 120 to effectively heat the food 30.

The support for the open package is preferably less than 25% reflective of the microwave.

A tube 103 is connected through a valve 103*a* to a supply of water or steam and which may be used for delivering an atomized spray of water or steam into the air heating chamber 115 for controlling the relative humidity and dew point of air circulated through air heating chamber 115 and cooking chamber 120.

Figure 13:
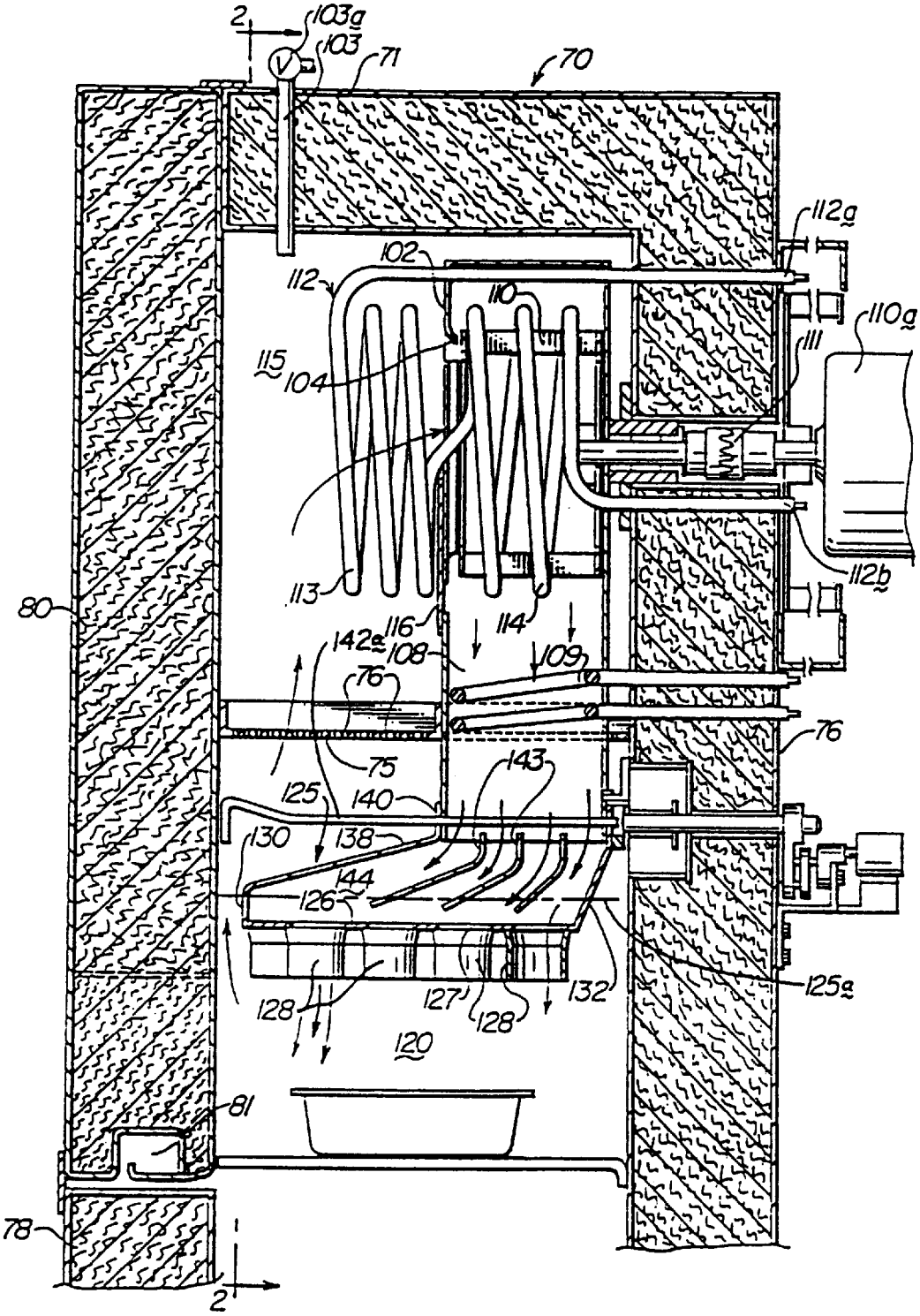
FIG. 13 is a cross-sectional view taken along line 13—13 of FIG. 12.
Figure 14:
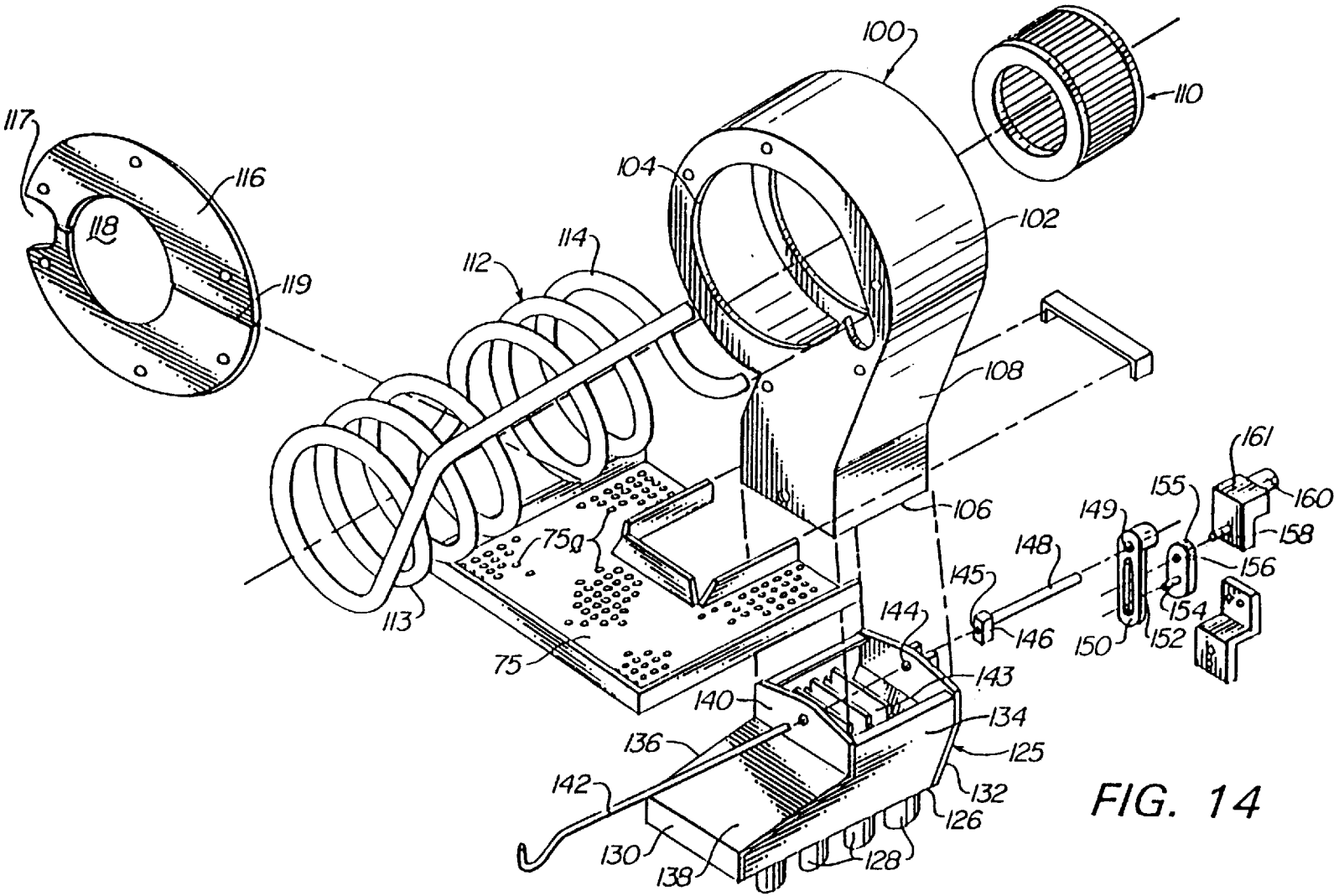
FIG. 14 is an exploded perspective view of the air dispensing apparatus.

Referring to FIGS. 12, 13 and 14 of the drawing, air circulating apparatus generally designated by the numeral 100 comprises a blower housing 102 having an inlet opening 104 and a discharge opening 106. As illustrated in FIGS. 12 and 14, blower housing 102 is in the form of a volute and a plenum section 108 is formed adjacent the discharge opening 106.

A radial flow fan impeller 110 draws air axially through inlet opening 104 and discharges air radially through plenum section 108 and discharge opening 106.

A heating element 112, having coils 113 of a first stage and coils 114 of a second stage, is mounted for heating air drawn into the blower housing 102.

As best illustrated in FIG. 13 of the drawing, the interior of the oven cabinet 70 is divided by a perforated plate 75 to form an air heating chamber 115 and a cooking chamber 120. Perforated plate 75 is constructed of a metallic material and has perforations 76*a* with relatively small openings preferably equivalent to more than about 50% of the surface area. The perforated metal plate 75 prevents passage of microwave energy into the air heating chamber 115.

Figure 20:
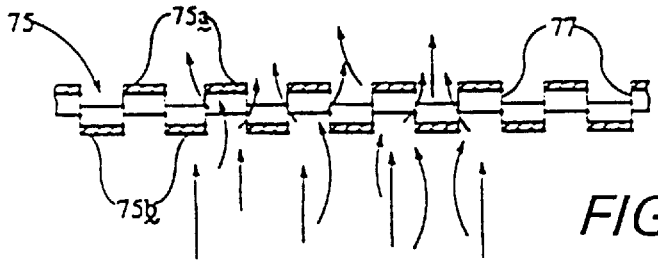
FIG. 20 is a cross-sectional view taken along line 20—20 of FIG. 18.
Figure 18:
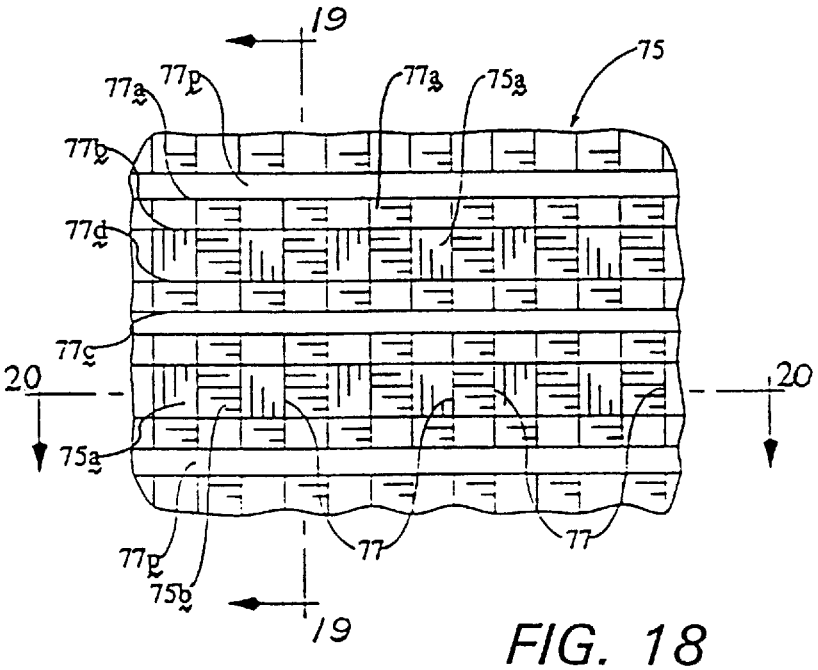
FIG. 18 is a fragmentary elevational view of a portion of the partition between the cooking chamber and the air conditioning chamber.
Figure 19:
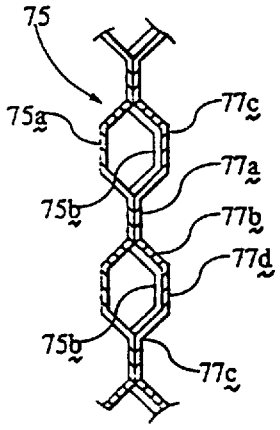
FIG. 19 is a cross-sectional view taken along line 19—19 of FIG. 18.

The perforated plate 75 forms a splatter shield on which airborne spoil accumulates. Referring to FIGS. 18–20 of the drawing, perforated plate 75 is preferably a single sheet of metallic material having rows of slits 77 which extend longitudinally of the sheet. Central portions of the sheet are deflected along lines 77*a*, 77*b*, 77*c* and 77*d*, without removing material from the sheet to form air passages through the sheet. Between adjacent slits 77 sections of the central portions of the sheet are deflected upwardly to form upwardly extending ridges 75*a*, by bending the material along lines 77*a*, 77*b*, 77*c* and 77*d*. Other segments of the sheet are deflected to form downwardly extending ribs 75*b* by bending the material downwardly along fold lines 77*a*–77*d*.

When adjacent segments 75*a* and 75*b* of sheet 75 are deflected in opposite directions air passages 75*c* are formed in the sheet.

The perforated partition 75 constructed of metallic material and due to its geometric configuration forms a barrier which prevents passage of microwave energy into the air heating chamber 115. This significantly contributes to reducing the propagation of microwave energy through passages formed in the wall of the air heating chamber through which fan drive shafts, electrical conductors, steam injectors, and ventilation ducts are mounted.

Further, the perforated sheet 75 significantly aids in removing grease and other particulate material from the recirculating air and is preferably mounted for easy removal for cleaning.

In heavy duty food service ovens, cleaning is a major consideration.

Sheets of the same perforated material are preferably mounted to form removal splatter shields 75*s* adjacent opposite sides of the food product to form an oven liner which is easily removable for cleaning. Soil collector pans or trays 165 extend around the food product to catch any food particles which may be dislodged from the cooking container during the cooking process.

A coating or layer 75*d* of non-conductive insulator material is applied to at least one surface of the perforated sheet 75. If it is deemed expedient to do so, only top surfaces of deflected portions 75*a* between fold lines 77*b* and 77*d* may be coated with insulator material to prevent microwave arcing between surfaces of perforated sheet 75 and a metallic pan surface.

Microwave energy at a frequency of 2,450 megahertz tends to arc when two metal surfaces approach each other at a low angle. The arcing not only wastes heating energy, it can cause fires in dry products and can pit the metal surfaces.

Heretofore, applying porcelain coatings to flat metallic sheets to prevent arcing has resulted in the porcelain coating tending to chip and crack when the flat sheet of metal is deflected. However, the perforated sheet 75 having portions 75*a* and 75*b* deflected outwardly in opposite directions from a central planar portion 75*p* is relatively stiff which significantly reduces the tendency of the ceramic coating 75*d* to crack or chip. Coatings of other materials such as fluorocarbon resins and fluorine plastics, including tetrafluroethylene (Teflon®) may be used.

As best illustrated in FIG. 13 of the drawing, the first stage of coils 113 is mounted in air heating chamber 115 outside of the blower housing 102 while the second stage of coils 114 is mounted inside blower housing 102. Terminals 112*a* and 112*b* of heating element 112 are connectable to a suitable source of electricity.

As illustrated in FIG. 14 of the drawing, a mounting plate 116 having a notch 117 formed in the periphery thereof and a central opening 118 is bolted or otherwise secured to blower housing 102 for supporting heating element 112. Plate 116 is formed in two parts which are connectable along a part line 119.

As illustrated in FIG. 3, blower 110 is mounted on a shaft which is driven through a coupling 111 by a motor 110*a*.

Coils of a third stage heating element 109 are mounted in the plenum section 108 of blower housing 102 and positioned such that air delivered radially from blower 110 is heated immediately prior to being delivered through discharge opening 106. It should be readily apparent that only coils 109 may be activated while coils 113 and 114 are idle, if it is deemed expedient to do so depending upon the heating requirements of a particular food product.

An air dispensing duct generally designated by the numeral 125 is secured to plenum 108 for receiving air from discharge opening 106.

As best illustrated in FIGS. 13 and 14 of the drawing, air dispensing apparatus 125 comprises a tapered duct formed by a perforated plate 126 having an array of passages formed therein which communicate with tubes 128. A front wall 130 and a rear wall 132 extend upwardly from the perforated plate 126 and are connected between side walls 134 and 136. An inclined top wall 138 extends between front wall 130 and a flange 140 encircling the lower end of plenum 108 and enclosing the discharge opening 106 from the blower housing 102.

As illustrated in FIG. 13 of the drawing, air directing vanes 143 extend between side walls 134 and 136 of the tapered duct 125 for distributing air along the length of the interior 144*a* of the tapered duct 125. Air directing vanes 143 are configured to deliver temperature controlled air into the duct substantially parallel to a longitudinal axis 125*a* of duct. Streams 128*a* and 128*b* of air are directed transversely of the axis 125*a* from said duct toward the food product 30. As the duct reciprocates about the axis 142*a* of pin 142, which is parallel to the axis 125*a* of the duct, streams 128*a* and 128*b* of air impinge on discrete areas on the surface of the food product 30 to transfer heat between the air streams and the surface of the food product 30.

The air dispensing apparatus 125 is pivotally secured to duct plenum 108 by a pivot pin 142 extending through aligned apertures 144 in flange 140. Pivot pin 142 extends into an opening 145 formed in lug 146 on shaft 148 which extends into an aperture 149 on a link 150. Link 150 has an elongated slot 152 formed therein into which a pin 154 on crank 155 extends.

Crank arm 155 has an aperture which receives a drive shaft 158 driven by motor 160 through a gear reducer 161.

A radial blower 110 discharges its highest velocity air from the outer portion of the volute downwardly through shaped openings in tubes 128 to impinge upon a narrow food product 30 in the open top container 18.

The air dispensing duct 125 is moved relative to the product 230 to give uniform coverage by the air streams. As best illustrated in FIGS. 11 and 12, the end walls 222 and 223 of the container 218 cause a portion of the air stream to be deflected to heat the sides and bottom 231 of product 230 in the container. The movement applies the air streams near one side of the container adjacent end wall 222 and then to the other side adjacent end wall 223 so that parts of the air streams are alternately applied to opposite exposed sides of the product 230 and are caused to alternate the lateral flow through loose stacks of food products 230 such as curled or random lengths of french fried potatoes. This alternating lateral air flow through paths 228 between support ribs 225 passes under and heats the lower side 231 of irregularly shaped products such as bone-in chicken parts.

The effectiveness of the sideways air heating of lower surfaces 231 can be enhanced by ribs 225 to provide air passages under flat products.

Further, the moving air dispensing apparatus 125 provides moving reflective surfaces which serve as stirrers to help distribute the microwave energy in the cooking chamber 120.

The combination of extended orifices through tubes 128, and the open top container 18 provides air escape path 129 while bringing the orifice to an optimum distance from the product 230. It should be noted that upper edges of the sides 220 and 221 and ends 222 and 223 of container 218 extend above the height of the contained product 230 to enhance air flow between the lower surface 231 of the product 230 and the bottom 224 of container 218.

As illustrated in FIG. 12 of the drawing, streams of air dispensed from air dispensing duct 125 through hollow air dispensing tubes 128 impinge upon the upper surface of a food product 230 in container 218. The spent air travels through space 129 between tubes 128, as illustrated in FIGS. 12 and 13 of the drawing. Spent air travels upwardly adjacent baffles 75*s* and is drawn upwardly through passages 75*c* formed in the perforated plate 75.

Soil collector pans 165 are preferably removably mounted and are maintained at a temperature which is less than the temperature of any other surface in the oven 70 for causing very fine smoke-type particles in the moving air to be collected on the coldest surface in the recirculating path. To assure that the soil collection pans 165 are maintained cooler than other surfaces in oven 70, the pans may be exposed to outside air or water cooling to facilitate collecting aerosol from the recirculating air.

If the food product 230*a* in the container is strips or slices of pasta, potatoes or other particulate material, air from stream 128*a* will be delivered through the stacked material in heat transfer relation with the surface of the pieces of the food product.

If food product 230 is a solid article, as designated by the numeral 230 in FIGS. 11 and 12 of the drawing, air dispensing duct 125 is preferably rocked causing air streams 128*a* and 128*b* to move across the surface of the food product between lateral edges thereof such that regions of controlled air pressure are alternately formed adjacent opposite sides of the product 230 such that temperature controlled air flows through passage 228 between the lower surface 231 of the food product and the upper surface 225*a* of the bottom 224 of container 218.

After the surface of the food product 30 has been heated by air streams 128*a* and 128*b,* the recirculating air tends to limit localized heating of the product by microwave energy delivered by magnetrons 92. Tips and thin areas of the product that are rapidly heated by the microwave energy may actually dissipate heat to air in streams 128*a* and 128*b* to provide cooling to certain portions of the food product.

After the food product 30 in container 18 has been sufficiently heated, air flow through the air circulating apparatus 100 is terminated and magnetrons 92 are turned off.

It should appreciated that other and further embodiments of the invention may be devised without departing from the spirit and scope of the appended claims.

It is claimed:

1. A method for transferring heat between temperature controlled air and a food product in a cooking chamber in a microwave oven comprising:

delivering temperature controlled air substantially parallel to an axis into a duct having a surface formed of microwave reflective material;

dispensing a stream of air from said duct into the cooking chamber in a direction generally transverse to said axis; and reciprocating said duct about said axis such that said microwave reflective surface on said duct reflects and distributes microwave energy in the cooking chamber.

2. A method of transferring heat according to claim 1, the step of delivering temperature controlled air substantially parallel to an axis into a duct comprising the steps of:

delivering air through an array of air directing vanes for distributing air along the length of the interior of the duct.

3. A method of transferring heat according to claim 1, the step of delivering temperature controlled air substantially parallel to an axis into a duct comprising the steps of:

delivering air through a tubular member; and mounting said duct for reciprocal movement about said tubular member.

4. A method of transferring heat between temperature controlled air and the food product according to claim 1, the step of delivering temperature controlled air substantially parallel to an axis into a duct comprising the steps of:

drawing spent air resulting from impingement of said stream on the food product along an air return path;

positioning a foraminous member having passages formed therein such that said spent air flows through passages in said foraminous member, said foraminous member being configured such that airborne particles in said spent air are retained by said foraminous member.

5. A method of transferring heat according to claim 4, said foraminous member being formed to prevent passage of microwave energy along said return path through said foraminous member.

6. Apparatus for transferring heat between temperature controlled air and a food product in a microwave oven comprising:

a cooking chamber;

plenum means having an air return opening;

outlet means on said plenum means having a central axis;

an elongated duct having microwave reflective surfaces and having an entrance opening and an outlet opening;

means supporting said duct for reciprocal movement about said axis; and coupler means for placing said entrance opening in said duct in fluid communication with said outlet means on said plenum means such that air is delivered from said plenum means into said duct and such that said microwave reflective surfaces provide uniform energy distribution of microwave energy within the cooking chamber and consistent heating of a food product in the cooking chamber.

7. Apparatus for transferring heat between temperature controlled air and a food product according to claim 6, said elongated duct having a microwave reflective fin which rotates about said axis.

8. Apparatus for transferring heat between temperature controlled air and a food product according to claim 6, said elongated duct having microwave reflective angularly inclined surfaces.

9. Apparatus for transferring heat between temperature controlled air and a food product according to claim 6, with the addition of a second elongated duct having microwave reflective surfaces and having an entrance opening and an outlet opening, said coupler means moving said ducts such that said microwave reflective surfaces on each of said ducts move at different periodic phases at the same periodic frequencies such that one duct is in the middle of its range of movement when the other duct approaches an end of its range of movement to distribute microwave energy within the cooking chamber.

10. Apparatus for transferring heat between temperature controlled air and a food product according to claim 9, each of said elongated ducts having a microwave reflective fin which rotates about said axis.

11. Apparatus for transferring heat between temperature controlled air and a food product according to claim 8, said outlet opening in said duct being configured to dispense a stream of air to impinge against the surface of a food product.

12. Apparatus for transferring heat between temperature controlled air and a food product according to claim 6, with the addition of: insulated bumper pins in said cooking chamber for positioning a pan in spaced relation from walls of said cooking chamber.

13. Apparatus for transferring heat between temperature controlled air and a food product according to claim 6, said coupler means comprising:

sleeve means configured to telescopically receive a portion of said outlet means.

14. Apparatus for transferring heat between temperature controlled air and a food product according to claim 6, said coupler means comprising:

means delivering air through said entrance opening in a direction substantially parallel to said axis about which said duct reciprocates.

15. Apparatus for transferring heat between temperature controlled air and a food product according to claim 6, with the addition of:

a foraminous member having a substantially planar surface and having deflected portions forming passages permitting flow of air through said passages in a direction generally parallel to said substantially planar section of said foraminous member such that the direction of air flowing generally perpendicular to said foraminous member enroute to said return opening in said plenum is changed from a first direction generally perpendicular to said foraminous member to a second direction generally parallel to said foraminous member and then to a third direction generally perpendicular to said foraminous member.

16. Apparatus for transferring heat between temperature controlled air and a food product according to claim 15, said foraminous member having a non-conductive coating to electrically insulate said foraminous member.

17. Apparatus for transferring heat between temperature controlled air and a food product according to claim 15, said deflected portions of said foraminous member being formed to provide passages on opposite sides of said deflected portions wherein streams of air flowing in a first direction generally perpendicular to said foraminous member forms a plurality of streams of air flowing generally parallel to said foraminous member which collide to change direction to said third direction generally perpendicular to said foraminous member.

18. Apparatus for transferring heat between temperature controlled air and a food product according to claim 17, said passages in said foraminous member being configured to prevent passage of microwave energy through said foraminous member.

19. Apparatus for transferring heat between temperature controlled air and a food product comprising:

a cabinet having an interior compartment;

conductive top, bottom, front, side and rear walls on said cabinet extending around said compartment;

a plenum wall, said plenum wall forming a plenum in said compartment having an opening to provide an air return path;

at least one air dispenser communicating with said plenum for circulating air through said compartment;

microwave reflective surfaces extending into said compartment; and means mounting said microwave reflective surfaces for reciprocating movement between extremes of a range of movement such that at least one of said microwave reflective surfaces is moving in said range of movement between said extremes of movement when another of said microwave reflective surfaces reaches an extreme of said range of movement.

20. Apparatus for transferring heat between temperature controlled air and a food product according to claim 19, with the addition of foraminous partition means having a central portion and extremities configured to encircle a portion of said cooking chamber such that said air heating chamber extends around a major part of the periphery of the cooking chamber wherein air is drawn along multiple paths toward said side walls and toward said rear wall from said cooking chamber.

21. Apparatus for transferring heat between temperature controlled air and a food product according to claim 20, said foraminous partition means comprising:

a sheet having portions deflected outwardly in opposite directions from the plane of the sheet to form passages through which air flows in a direction generally parallel to the plane of the sheet while blocking air flow in a direction generally perpendicular to the plane of the sheet.

22. Apparatus for transferring heat between temperature controlled air and a food product according to claim 19, said air dispenser comprising:

a plurality of air dispensing ducts; and means pivotally supporting said air dispensing ducts in said heating chamber.

23. Apparatus for transferring heat between temperature controlled air and a food product according to claim 22, with the addition of:

drive means connected to each of said air dispensing ducts for causing said ducts to move in unison asynchronously.

24. Apparatus for transferring heat between temperature controlled air and a food product according to claim 23, said drive means connected to each of said air dispensing ducts comprising:

a motor;

a drive member driven by said motor; and a plurality of links extending between said drive member and said air dispensing ducts, one of said drive members being positioned relative to the other drive member such that said air dispensing ducts move asynchronously.

25. A microwave oven for heating food products comprising: a heating chamber having an electrically conductive wall, said wall having an opening for delivering electromagnetic energy into said heating chamber; at least two air dispensers in said heating chamber; means movably supporting said air dispensers adjacent opposite sides of said opening to direct air streams to impinge on discrete portions of the surface of a food product in said heating chamber; and means associated with said air dispensers for asynchronous movement of said dispensers for sweeping said air streams through said heating chamber and for sweeping electromagnetic waves through said heating chamber.

26. A microwave oven according to claim 25, said at least two air dispensers comprising:

a plurality of air dispensing ducts; and means pivotally supporting at least two of said plurality of air dispensing ducts in said heating chamber.

27. A microwave oven according to claim 26, said means associated with said air dispensers for asynchronous movement of said dispensers comprising:

drive means connected to each of said plurality of air dispensing ducts for causing said dispensers to oscillate out of phase.

28. A microwave oven according to claim 25, with the addition of:

a plurality of spaced partitions in said heating chamber dividing said heating chamber to form a cooking chamber and an air heating chamber, said partitions being configured to block passage of microwave energy into said air heating chamber while permitting flow of air from said cooking chamber into said air heating chamber.

29. A microwave oven according to claim 25, said partition means having a central portion and extremities configured to encircle a portion of said cooking chamber such that said air heating chamber extends around a major part of the circumference of the cooking chamber wherein air is drawn along multiple paths from said cooking chamber.

30. A microwave oven according to claim 29, said partition means comprising:

a removable oven liner having a configuration approximating that of said cooking chamber such that surfaces on said liner form foraminous walls around said food product to collect splattered material resulting from heating the food product.

* * * * *